US005853658A

United States Patent [19]

Aichinger et al.

[11] Patent Number: 5,853,658

[45] Date of Patent: Dec. 29, 1998

[54] GAS PURGING DEVICE IN THE BLOWPIPE OF A DEGASSING VESSEL

[75] Inventors: Klaus Aichinger, Villach, Austria; Heinrich Niehues, Mülheim/Ruhr, Germany

[73] Assignee: Veitsch-Radex Aktiengesellschaft fur Feuerfeste Erzeugnisse, Vienna, Austria

[21] Appl. No.: 776,817

[22] PCT Filed: Jul. 26, 1995

[86] PCT No.: PCT/EP95/02956

§ 371 Date: Apr. 24, 1997

§ 102(e) Date: Apr. 24, 1997

[87] PCT Pub. No.: WO96/03530

PCT Pub. Date: Feb. 8, 1996

[30] Foreign Application Priority Data

Jul. 26, 1994 [DE] Germany ..... 44 26 368.6
Mar. 29, 1995 [DE] Germany ..... 295 12 335 U

[51] Int. Cl.[6] ..... C21C 7/10

[52] U.S. Cl. ..... 266/217; 266/209; 222/603

[58] Field of Search ..... 266/217, 208, 266/209, 210; 222/603

[56] References Cited

U.S. PATENT DOCUMENTS 5,011,531 4/1991 Takahashi et al. ..... 266/209

FOREIGN PATENT DOCUMENTS 3911881 8/1990 Germany .
2145740 4/1985 United Kingdom .

OTHER PUBLICATIONS

Radex Rundschau, No. 4, "Development of Purge Elements for Degassing Units" pp. 365–376, Dec. 1990.

*Primary Examiner*—Scott Kastler
*Attorney, Agent, or Firm*—John F. A. Earley; John F. A. Earley, III; Harding, Earley, Follmer & Frailey

[57] ABSTRACT

A gas flushing device for a blowpipe of a degassing vessel, the blowpipe being cladded with a fire resistant material. The gas flushing device has a plurality of channels which are distributed around the circumference of the blowpipe and pass through the fire resistant cladding radially in relation to the central longitudinal axis of the blowpipe and can be connected on the outside to at least one gas feed pipe. The channels are between 0.5 and 2 mm in diameter, are spaced at intervals of less than 10 mm and can be pressurized in such a way that the gas on entering the blowpipe rises in the immediate vicinity of the blowpipe inner wall.

9 Claims, 1 Drawing Sheet

GAS PURGING DEVICE IN THE BLOWPIPE OF A DEGASSING VESSEL

DESCRIPTION

The invention refers to a gas purging device for a snorkel or blowpipe of a degassing vessel, the latter being lined with a refractory material.

From the DE 39 11 881 C1 a sintered gas purging plug is known, which is embedded into the side wall of an evacuation vessel in the region of the steel melt. Here, it is a discrete gas purging element.

The development of gas purging elements for degassing vessels is described in "Radex-Rundschau, No. 4, 1990, 365". It is mentioned there that in a typical installation the purging is effected with six to twelve tubes within the inlet blowpipe of the vacuum vessel, each having a diameter of 3 or 4 mm.

A RH method is described in "Radex-Rundschau, No. 4, 1992, 171", wherein, in the inlet blowpipe, argon is injected through steel tubes of 3 to 4 mm thickness.

In the RH (Ruhrstahl-Heraeus) method, the liquid steel is transported from a pouring ladle along an ascension pipe into the evacuation vessel with the aid of a conveying gas, in particular argon, which is fed into the ascension pipe above the level of the steel melt, by the increase of volume thereof within the ascension pipe and further by the difference in pressure between the external air pressure and the low pressure within the evacuation vessel. The steel being sucked into the evacuation vessel is atomized resulting in a great increase of surface and thus a good degassing. Simultaneously introduced oxygen being supplied from the slag, among others, during the whole treatment time, leads to the formation of carbon monoxide gassing out in the vacuum vessel, the desired decarbonization being achieved thereby.

It has been attempted to optimize the decarbonization to the lowest possible values by additionally blowing-in oxygen.

A fast decarbonization process is achieved in particular by a high circulation speed of the melt and thus an increase of the conveying gas flow, and by an increase of the blowpipe diameter of the vacuum installation.

In the EP 0 297 850 A1, a method and a device for degassing a molten metal in a RH process are described. For that, several channels are arranged in the inlet blowpipe at the periphery, which are divided into two groups, a group of which being supplied with high pressure gas and a group being supplied with low pressure gas. In this way the supplied flows of gas infiltrate into the molten metal being fed through the blowpipe with different depth to facilitate an uniform gassing of the molten metal over the blowpipe cross section.

The object of the invention is to optimize known gas purging devices for degassing vessels, in particular a decreased and more uniform wear behaviour of the refractory ceramic lining being intended.

The invention is based on the knowledge that this objective can be achieved by an "all around purging" of the steel being conducted through the blowpipe (the submerged nozzle) with an adequate treating gas, if the following parameters are taken into accountL:

The gas has to be injected into the melt in very fine bubbles,

The gas has to be supplied at the periphery in an almost continuous gas veil.

The gas supply has to be effected in such a way that the gas ascends only in the immediate region of the wall of the blowpipe.

The channels of the gas purging device should extend with a small distance between each other over the whole periphery and preferably over at least part of the height (for example 10 to 50%) of the refractory lining of the blowpipe.

An uniform, quasi "continuous" gas supply with fine distribution over the whole periphery of the blowpipe is required.

Accordingly, the invention in its most general embodiment refers to a gas purging device for a blowpipe of a degassing vessel, being lined with a refractory material, the gas purging device having a plurality of channels which run, distributed over the periphery of the blowpipe, through the refractory lining in radial direction with regard to the central longitudinal axis M of the blowpipe, and are connectable at the outside to at least one gas supply pipe, characterized in that the channels a) have a diameter between 0,5 and 2 mm, b) have a distance between each other of less than 10 cm, aid c) can be supplied with gas in such a way that the gas, after entry into the blowpipe, ascends directly adjacent to the inner wall thereof.

Such a design results in the following advantages: An uniform flow of liquid steel up to the inside of the vacuum vessel is achieved. The gas supply in fine bubbles, distributed over the whole periphery, facilitates a particularly fine distribution of the treating gas with a largely increased reaction volume between the treating gas and the steel melt at the same time. The gas ascends at the inner wall of the blowpipe and protects the refractory lining material of the blowpipe in the process. The result is a much more uniform and less wear of the refractory material not only within the blowpipe itself but also within the lower vessel.

A formation of buttons as sometimes observed in the middle and upper part of the vacuum vessel in the prior art: does hardly occur again. The time of treatment of the steal with alloying elements is shortened. Accordingly, the required amount of alloying agents decreases. Finally, a higher and faster decarbonizing capacity can be obtained so that smaller amounts of reductive media become necessary.

The constructive configuration of the ring-like gas purging device may be modified in different ways. In a first embodiment, a configuration of the gas purging device as a monolithic, cast or pressed, ring-shaped block is provided, in which, accordingly, the channels are arranged radially.

The ring-shaped block may as well consist of several refractory, for example pressed ring segments, the channels extending within the individual segments.

Each ring segment is formed with a corresponding number of channels, depending on its size, a further embodiment providing to connect the channels of a ring segment at the outside to a common gas distribution charter which itself, in turn, is connectable to a gas supply pipe. The gas distribution chambers may also be in fluid connection with each other so that only one gas supply pipe is required. The supplied gas flow is made more uniform thereby. This facilitates, in connection with the feature of the formation of channels having a very small opening width (or very small diameter), to operate with a considerable lower gas pressure, compared to the prior art, and in a way that the gas ascends directly after the entry into the blowpipe.

The shape and size of the ring segments can be varied within wide limits. So, for example, it is possible to assemble the ring-shaped gas purging device often ring segments altogether. Each ring segment in turn may consist of several bricks, the channels being formed within all said bricks.

Regardless of the constructive configuration of the ring-shaped gas purging device the gas channels can be arranged in rotational symmetry over the periphery of the refractory lining of the blowpipe. A particularly uniform, radial gas supply into the molten metal is guaranteed thereby. If the gas channels are formed with different diameters (for example 0,5 to 1,5 mm) or cross sections (circular, slit-like, etc.), also the gas pressure can be adjusted from channel to channel so that the gas supplied each time can infiltrate into the molten metal with different depth, however, according to the invention always only over a relatively short distance, as described.

The channels may be simple bores; according to an embodiment, the channels are formed by metal tubes embedded securely in the refractory lining.

The distribution of the treating medium within the molten metal is further improved in that the gas channels are arranged alternatingly offset in height. The following example shows such an embodiment in detail.

Typically, the channels are aligned horizontally; but an arrangement of the channels inclined to the horizontal is also possible, the channels, for example, being aligned in such a way that the gas supply is effected against the direction of flow of the molten metal.

Metallurgically, the described formation of a gas purging device, wherein the molten metal conducted through the blowpipe is supplied uniformly, almost continuously at the periphery with finest gas bubbles, results in a clearly unexpected advantage of the treatment of the molten metal and at the same time to an improvement of durability of the refractory material.

Further features of the invention are given by the features of the subclaims and the other application documents.

Now, the invention will be described in further detail with reference to an embodiment.

Here—each schematically

BRIEF DESCRIPTION OF THE DRAWINGS

FIG. 1 shows a partly perspective view of a RH degassing vessel and in particular the region of interest of two blowpipes (inlet blowpipe 10, outlet blowpipe 12).

A refractory lining 14 can be seen in the cut-open part of the blowpipe 10, which, in this case, consists of seven ring-like planes 16*a* . . . *f* being arranged above each other. Each plane 16*a* . . . *f* is assembled of refractory bricks 18.

Figure 2:
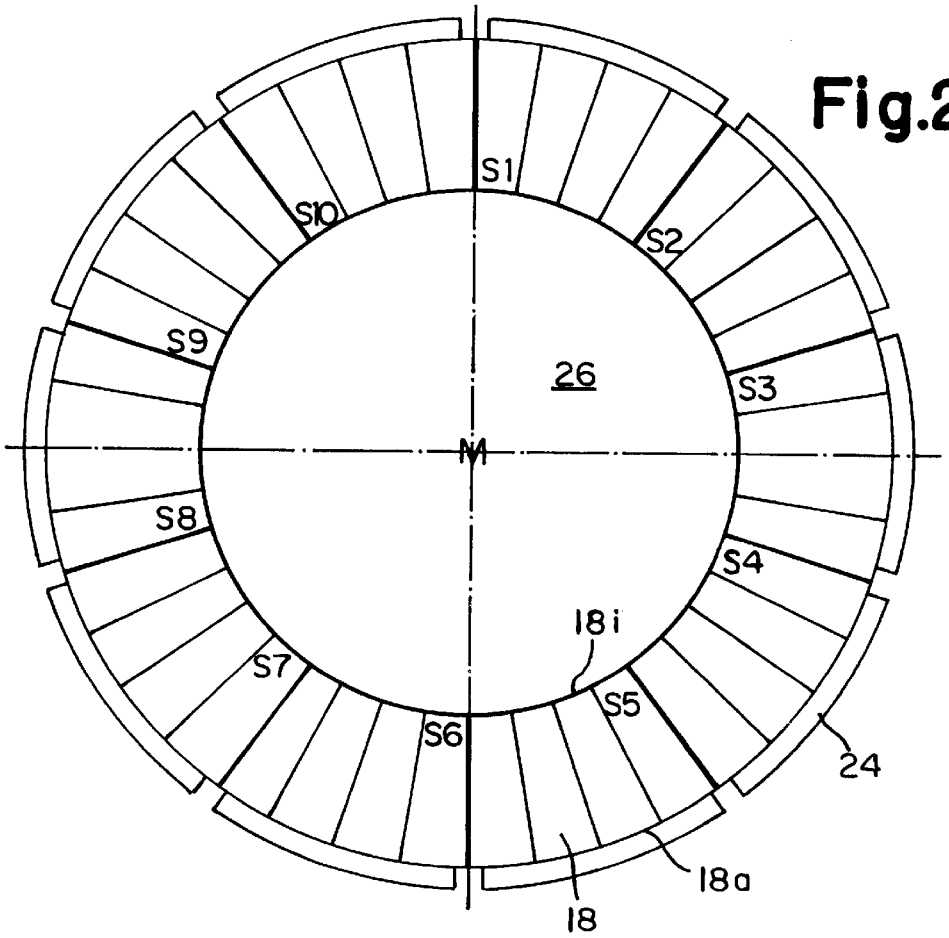
FIG. 2 shows a plan view of a gas purging device according to the invention.

Together, the plugs 18 of the plane 16*d* form a gas purging device according to the invention, which is illustrated, in detail, in plan view in FIG. 2.

FIG. 2 shows that, together, forty bricks 18 form the ring-shaped plane 16*d* and each four bricks 18 are combined to a ring segment S1 to S10, respectively. The bricks 18 or segments S1 to S10 are mortared to each other at their corresponding side faces.

Figure 1:
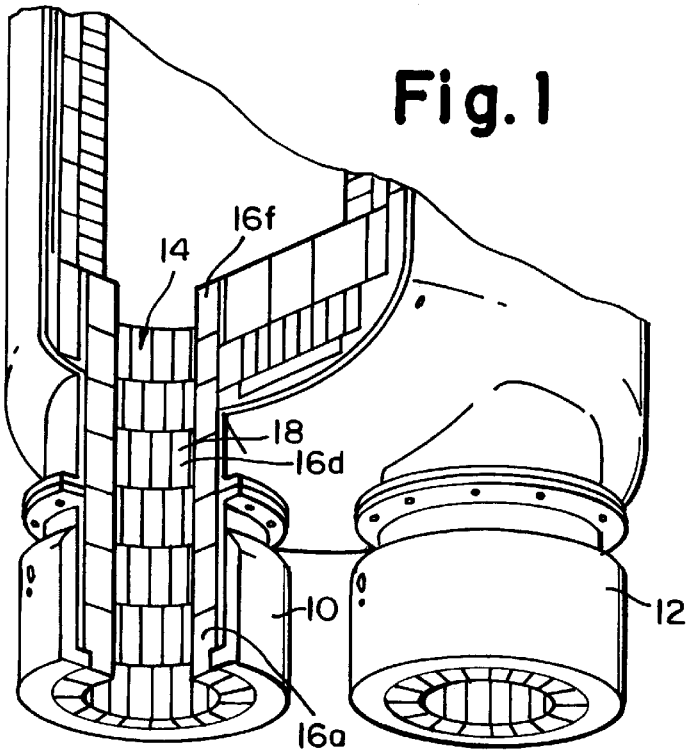
FIG. 1 shows a perspective, partly torn open view of a RH degassing vessel.
Figure 3:
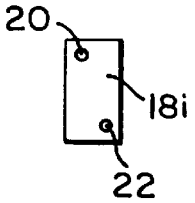
FIG. 3 shows a front view of a brick of the gas purging device according to FIG. 2.

As shown in FIG. 3, each brick 18 has two channels 20, 22 being aligned horizontally and arranged radially with regard to the central longitudinal axis M of the blowpipe 10, which channels are arranged offset in height laterally, the distance between them being approximately 5 cm, both between the channels 20, 22 of one brick and between the channels of adjacent bricks.

The channels 20, 22 (each with an inner diameter of 1 mm) run from the outer surface 18*a* to the inner surface 18*i* of the plugs 18, respectively.

Each segment S1 to S10 has on its outside a gas distribution chamber 24 being directly connected, which is connected gastightly to the outside and is made of metal. Correspondingly, the channels 20, 22 run at the outside into the space formed by the gas distribution chamber 24.

Each gas distribution chamber 24 has a supply region (not illustrated herein) along which the gas distribution chamber 24 is supplied with the treating medium which then can be injected into the inner space 26 of the blowpipe via the channels 20, 22, the close-meshed, uniform and offset-in-height distribution of the channels 20, 22 over the periphery of the gas purging device and the radial alignment ensure that the treating medium, for example argon, is injected radially, uniformly in the direction towards the molten metal flowing within the space 26. By this a kind of continuous, ring-shaped gas veil is formed, which ascends at the cylindrical inner wall of the blowpipe 10.

Alternatively, it would be possible to connect (tangentially) the individual gas distribution chambers 24 and to lead only one gas supply pipe into one gas distribution chamber 24. In any case it is ensured that the same gas pressure develops over all channels 20, 22.

It lies within the scope of the invention to form not only one plane 16*a* . . . *f* as a gas purging device according to the invention, but also several planes 16*a* . . . *f* which may be adjacent or spaced apart.

The arrangement of the channels 20, 22 may vary from brick to brick 18.

We claim:

1. A gas purging device for a blowpipe (10, 12) of a degassing vessel, the vessel being lined with a refractory material, the gas purging device having a plurality of channels (20, 22) with a diameter between 0.5 and 2 mm which run, in rotational symmetry over the periphery of refractory material of the blowpipe (10, 12), through the refractory lining (14) in radial direction with regard to the central longitudinal axis M of the blowpipe (10, 12), and are connectable at the outside to at least one gas supply pipe, wherein the channels (20, 22)

a) have a distance between each other of less than 10 cm, b) are offset in height, c) have different cross sections, and d) can be supplied with gas in such a way that the gas, after each entry into the blowpipe (10, 12), infiltrates into the molten metal with different depth, however only over a relatively short distance and further ascends directly adjacent to the inner wall thereof.

2. The gas purging device according to claim 1 in the form of a monolithic, ring-shaped block of refractory material having channels extending therein.

3. The gas purging device according to claim 1 in the form of a ring-shaped block of a refractory material, which is formed by several refractory ring segments S1 to S10 having channels (20, 22) arranged therein.

4. The gas purging device according to claim 3, wherein each ring segment S1 to S10 consists of several bricks (18), through each of which at least one channel (20, 22) extends.

5. The gas purging device according to claim 1, wherein the distance of adjacent channels is between 2 and 7 cm.

6. The gas purging device according to claim 1, wherein the channels (20, 22) at the end towards the gas supply run in groups or altogether into a common gas distribution chamber (24).

7. The gas purging device according to claim 1, wherein the diameter of the channels is 1 mm or less.

8. The gas purging device according to claim 1, wherein the channels (20, 22) are formed by metal tubes embedded securely in the refractory lining (14).

9. The gas purging device according to claim 1, wherein the channels (20, 22) are inclined to the horizontal.

* * * * *